US009868599B2

(12) United States Patent
Okumura et al.

(10) Patent No.: US 9,868,599 B2
(45) Date of Patent: Jan. 16, 2018

(54) SHEET FEEDING DEVICE

(71) Applicant: PFU LIMITED, Kahoku-shi, Ishikawa (JP)

(72) Inventors: Hideyuki Okumura, Ishikawa (JP); Masanobu Hongo, Ishikawa (JP)

(73) Assignee: PFU LIMITED, Ishikawa (JP)

( * ) Notice: Subject to any disclaimer, the term of this patent is extended or adjusted under 35 U.S.C. 154(b) by 0 days.

(21) Appl. No.: 15/419,181

(22) Filed: Jan. 30, 2017

(65) Prior Publication Data

US 2017/0137241 A1 May 18, 2017

Related U.S. Application Data

(63) Continuation of application No. PCT/JP2014/077259, filed on Oct. 10, 2014.

(51) Int. Cl.
*B65H 7/08* (2006.01)
*B65H 3/06* (2006.01)
(Continued)

(52) U.S. Cl.
CPC ..... *B65H 3/06* (2013.01); *B65H 1/06* (2013.01); *B65H 7/02* (2013.01);
(Continued)

(58) Field of Classification Search
CPC ..... B65H 1/025; B65H 1/06; B65H 2601/22; B65H 2405/111; B65H 2405/111646; B65H 2405/11171; B65H 2405/1124
See application file for complete search history.

(56) References Cited

U.S. PATENT DOCUMENTS 5,127,643 A 7/1992 DeSanctis et al.
5,552,859 A 9/1996 Nakagawa et al.
(Continued)

FOREIGN PATENT DOCUMENTS

CN 2513965 Y 10/2002
CN 201144115 Y 11/2008
(Continued)

OTHER PUBLICATIONS

Search Report issued in corresponding International Patent Application No. PCT/JP2014/077259, dated Jan. 13, 2015.
(Continued)

*Primary Examiner* — Howard Sanders
(74) *Attorney, Agent, or Firm* — McDermott Will & Emery LLP

(57) ABSTRACT

In a sheet feeding device, a document mounting board includes a first member that includes a first mounting surface and is located on the feed mechanism side in the feeding direction of the documents in the feed mechanism, the first mounting surface being inclined to a lower side toward the feed mechanism, and a second member that includes a second mounting surface on which the documents are mounted and is disposed on a side opposite to the side of the first member on which the feed mechanism is located, and the second member is connected to the first member to be rotatable about a second turning shaft and turns about the second turning shaft depending on the weight of the documents detected by the weight sensor to change an angle with respect to the first member.

6 Claims, 14 Drawing Sheets

(51) Int. Cl.
*B65H 7/02* (2006.01)
*B65H 1/06* (2006.01)

(52) U.S. Cl.
CPC ..... *B65H 2405/1124* (2013.01); *B65H 2405/111646* (2013.01); *B65H 2553/00* (2013.01); *B65H 2601/22* (2013.01)

(56) References Cited

U.S. PATENT DOCUMENTS

| | | | | |
|---|---|---|---|---|
| 5,951,002 | A * | 9/1999 | Yokota | B65H 1/20 271/117 |
| 6,260,841 | B1 * | 7/2001 | Tranquilla | B65H 1/025 271/127 |
| 2010/0133743 | A1 | 6/2010 | Hamasaki et al. | |
| 2011/0012300 | A1 | 1/2011 | Hsu et al. | |

FOREIGN PATENT DOCUMENTS

| | | | |
|---|---|---|---|
| CN | 101654193 | A | 2/2010 |
| CN | 101750926 | A | 6/2010 |
| JP | S57-067437A | A | 4/1982 |
| JP | H05-40232 | U | 5/1993 |
| JP | 05-281806 | A | 10/1993 |
| JP | 07-223742 | A | 8/1995 |
| JP | 2006-062762 | A | 3/2006 |
| JP | 2007-137526 | A | 6/2007 |
| JP | 2008-030939 | A | 2/2008 |
| JP | 2009-029546 | A | 2/2009 |
| JP | 2009-242102 | A | 10/2009 |

OTHER PUBLICATIONS

Office Action issued in corresponding Chinese Patent Application No. 201480082522.9, dated Sep. 27, 2017.

* cited by examiner $F_9 = M \times g$
$F_{10} = F_9 \times \sin \theta\ sh_1$
$F_{11} = F_9 \times \cos \theta\ sh_1$
$F_{12} = F_{11} \times \mu_{p\text{-}p}$
$F_{13} = F_{10} - F_{12}$

SHEET FEEDING DEVICE

CROSS-REFERENCE TO RELATED APPLICATION

This application is a continuation of International Application No. PCT/JP2014/077259, filed on Oct. 10, 2014, the entire contents of which are incorporated herein by reference.

FIELD

The present disclosure relates to a sheet feeding device.

BACKGROUND

More image scanners that read an image of a document and electrically process the read image, or more printers that print an image, have employed a sheet feeding device that feeds a sheet such as a document from which an image is read or a paper sheet on which an image is printed to an image reading unit or a printing unit. Sheet feeding devices are known in which a bundle of documents mounted on a document mounting board are aligned with each other, a contact state of a document with a pickup roller is adjusted, or a speed at which a document moves to a sheet feed position is changed depending on a weight of the document so as to properly feed the document mounted on the document mounting board (for example, see Japanese Laid-open Patent Publication No. 2009-242102, Japanese Laid-open Patent Publication No. 2007-137526, and Japanese Laid-open Patent Publication No. 2008-30939.)

However, in a sheet feeding device in which an document mounted on a document mounting board moves to a position of a pickup roller by its own weight, when the number of documents is large and the weight of the documents is large, a separation member that separates the documents other than the document fed by the pickup roller may be pushed up by the bundle of documents. In this case, it may be difficult to properly separate the documents with the separation member and so-called overlap feeding of feeding a plurality of documents may occur. The overlap feeding causes a paper jam and thus does not need to occur. However, by only aligning a bundle of documents or adjusting a contact state of the document with the pickup roller, it is difficult to suppress occurrence of the overlap feeding and it is very difficult to prevent from occurring the overlap feeding.

SUMMARY

According to an aspect of an embodiment, a sheet feeding device includes: a document mounting board configured to have documents mounted thereon; a document weight detecting unit configured to detect a weight of the documents mounted on the document mounting board; and a feed mechanism configured to include a pickup roller rotating to forward the documents and to feed the document at the lowermost among the documents mounted on the document mounting board to a downstream side in a feeding direction of the documents, wherein the document mounting board includes a first member that includes a first mounting surface on which the documents are mounted and that is located on the feed mechanism side in the feeding direction of the documents in the feed mechanism, the first mounting surface being inclined to a lower side toward the feed mechanism, and a second member that includes a second mounting surface on which the documents are mounted and that is disposed on a side opposite to the side of the first member on which the feed mechanism is located, and the second member is connected to the first member to be rotatable about a turning shaft parallel to a rotation shaft of the pickup roller, and turns about the turning shaft depending on the weight of the documents detected by the document weight detecting unit to change an angle with respect to the first member.

The object and advantages of the disclosure will be realized and attained by means of the elements and combinations particularly pointed out in the claims.

It is to be understood that both the foregoing general description and the following detailed description are exemplary and explanatory and are not restrictive of the disclosure, as claimed.

DESCRIPTION OF EMBODIMENTS

Hereinafter, a sheet feeding device according to an embodiment of the present disclosure will be described in detail with reference to the accompanying drawings. The present disclosure is not limited to the embodiment. Elements in the following embodiment include elements that can be easily replaced by those skilled in the art or elements that are substantially equal to each other.

Embodiment

Figure 1:
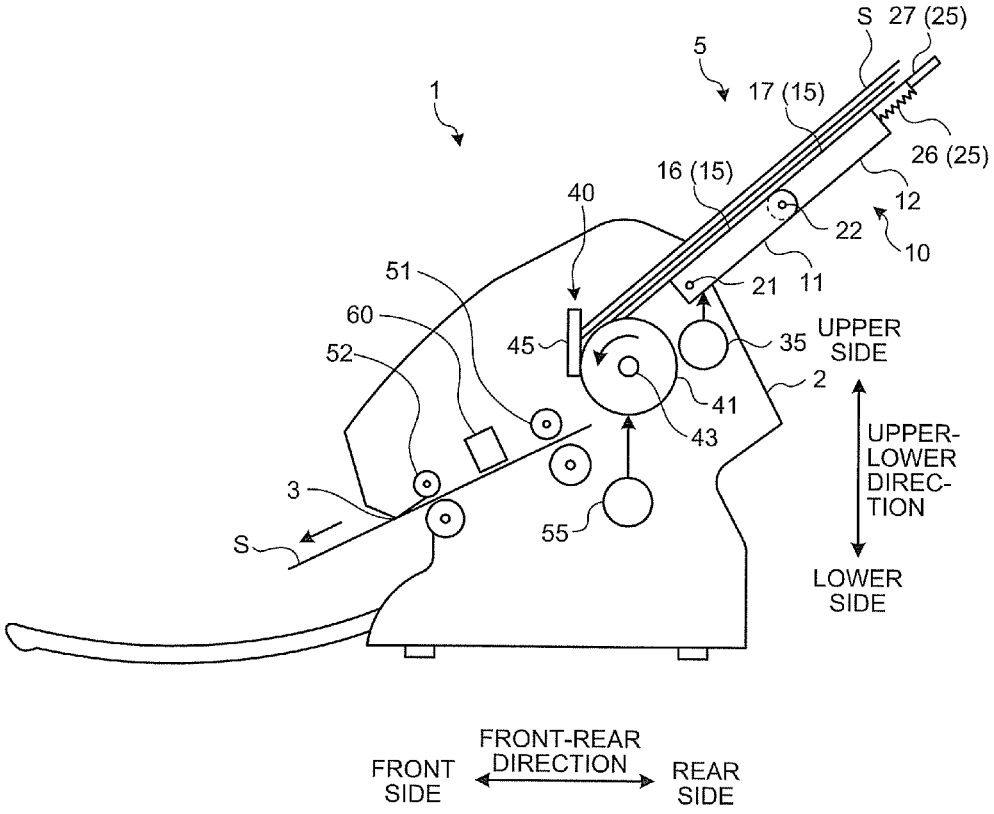
FIG. 1 is a diagram schematically illustrating a scanner including a sheet feeding device according to an embodiment.

FIG. 1 is a schematic diagram illustrating a scanner including a sheet feeding device according to an embodiment. A sheet feeding device 5 of a scanner 1 illustrated in FIG. 1 is configured as a device that separates documents S which are a plurality of feeding mediums stacked one by one and conveys the separated document S to an image reading unit 60 by which an image of the document S is read. The sheet feeding device 5 includes a document mounting board 10 on which the documents S to be forwarded to the image reading unit 60 are mounted. The document mounting board 10 is attached to a scanner body 2 of the scanner 1 so as to be inclined from up to down from an upstream side to a downstream side in a conveyance direction of the document S when the scanner 1 is used. A top surface thereof serves as a mounting surface 15 on which the documents S are mounted.

The sheet feeding device 5 includes a feed mechanism 40 that feeds the document S mounted on the document mounting board 10 to the downstream side in the feeding direction of the document S, and the scanner body 2 also serves as a base portion that supports the feed mechanism 40. That is, constituent members of the feed mechanism 40 are directly or indirectly attached to the scanner body 2 as the base portion. The feed mechanism 40 attached to the scanner body 2 in this way includes a pickup roller 41 that rotates to forward a document S and a separation member 45 that can separate the document S to be fed by the pickup roller 41 and feed only one document to the image reading unit 60.

Among these, the pickup roller 41 is formed in a substantially columnar shape, an outer circumferential surface thereof is formed of a member such as rubber having a relatively high frictional coefficient, and a rotation shaft 43 thereof is perpendicular to a conveyance direction of the document S and is rotatable in a direction substantially parallel to a horizontal direction. An upper end of the outer circumferential surface of the pickup roller 41 is rotatable about the rotation shaft 43 toward the downstream side in the feeding direction of a document S by a driving force transmitted from a feed driving motor 55.

The separation member 45 is disposed in the vicinity of the pickup roller 41 and at a position downstream from the vicinity of the upper end of the pickup roller 41. The separation member 45 comes in elastic contact with the pickup roller 41 and can forward only one document to the image reading unit 60 by regulating movement of the documents S other than the document S in contact with the pickup roller 41 among the documents S moving downstream in the conveyance direction by the rotating pickup roller 41. Accordingly, the feed mechanism 40 can feed the lowermost document S among the documents S mounted on the document mounting board 10 to a downstream side in the feeding direction of the documents S.

The document mounting board 10 attached to the scanner body 2 includes a first member 11 and a second member 12. Among these, the first member 11 includes a first mounting surface 16 on which the documents S are mounted and is located close to the feed mechanism 40 in the feeding direction of the documents S in the feed mechanism 40. The first mounting surface 16 of the first member 11 is inclined downward toward the feed mechanism 40, and a downstream end thereof in the feeding direction of the documents S in the feed mechanism 40 is connected to the scanner body 2 to be rotatable about a first turning shaft 21 which is a turning shaft parallel to the rotation shaft 43 of the pickup roller 41.

The second member 12 includes a second mounting surface 17 on which the documents S are mounted, is disposed on a side opposite to the side of the first member 11 on which the feed mechanism 40 is located, and is connected to an end opposite to the side on which the feed mechanism 40 is located. In the second member 12, a downstream end in the feeding direction of the documents S in the feed mechanism 40 is connected to the first member 11 to be rotatable about a second turning shaft 22 which is a turning shaft parallel to the rotation shaft 43 of the pickup roller 41.

In both of the first member 11 and the second member 12, the top surfaces when the scanner 1 is normally used serve as the mounting surface 15 on which the documents S are mounted. That is, the first mounting surface 16, which is the mounting surface 15 of the first member 11 on which the documents S are mounted, and the second mounting surface 17, which is the mounting surface 15 of the second member 12 on which the documents S are mounted, are both formed on the top surfaces of the first member 11 and the second member 12 when the scanner 1 is normally used.

In this way, by transmitting a driving force generated by a mounting board driving motor 35 to the document mounting board 10 including the first member 11 and the second member 12, the second member 12 can turn relative to the first member 11. That is, the document mounting board 10 includes a transmission mechanism (not illustrated) transmitting a driving force generated by the mounting board driving motor 35 and thus the second member 12 of the document mounting board 10 can turn about the second turning shaft 22 relative to the first member 11.

In the second member 12, an extension 25 which can increase the total length of the document mounting board 10 in the feeding direction of the documents S in the feed mechanism 40, is disposed at the opposite end of the end on the first member 11 side. The extension 25 includes a plane extending from the second mounting surface 17 to an upstream side in the feeding direction of the documents S and includes a first extension 26 and a second extension 27. Among these, the first extension 26 is connected to the end of the second member 12 opposite to the end on the first member 11 side and is dispose to be stretchable upstream in the feeding direction of the documents S relative to the second member 12. The second extension 27 is connected to the end of the first extension 26 opposite to the end on the second member 12 side and is disposed to be stretchable upstream in the feeding direction of the documents S relative to the first extension 26.

In the scanner body 2, a conveyance roller 51 is disposed downstream from the feed mechanism 40 in the feeding direction of the documents S in the feed mechanism 40. On the downstream side of the conveyance roller 51 in the conveyance direction of the documents S in the conveyance roller 51, a discharge roller 52 is disposed in the vicinity of a discharge port 3 of the documents S. The image reading unit 60 is disposed between the conveyance roller 51 and the discharge roller 52 in the conveyance direction of the documents S, that is, is disposed downstream from the feed mechanism 40 in the feeding direction of the documents S in the feed mechanism 40. Accordingly, the image reading unit 60 can read an image of the document S fed by the feed mechanism 40.

Figure 2:
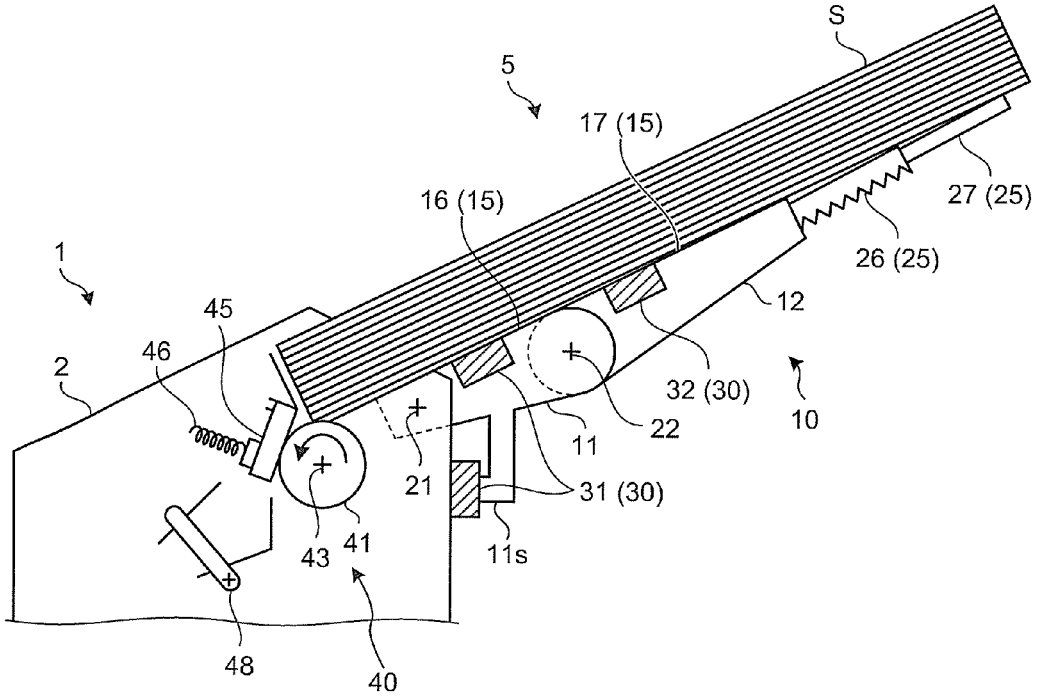
FIG. 2 is a detailed diagram of a document mounting board and a feed mechanism illustrated in FIG. 1.

FIG. 2 is a detailed diagram of the document mounting board and the feed mechanism illustrated in FIG. 1. The document mounting board 10 is provided with a weight sensor 30 as a document weight detecting unit that defects the weight of the documents S mounted on the mounting surface 15. The weight sensor 30 is disposed in each of the first member 11 and the second member 12, and a first weight sensor 31 disposed in the first member 11 and a second weight sensor 32 disposed in the second member 12, are provided as the weight sensor 30. Among these, the first weight sensor 31 is disposed at a position in contact with the first mounting surface 16, and the second weight sensor 32 is disposed at a position in contact with the second mounting surface 17 of the second member 12.

The first weight sensor 31 may be disposed at a position other than the position in contact with the first mounting surface 16. For example, the first member 11 may be provided with a first member support 11*s* that comes in contact with the scanner body 2 below the first member 11 to support the first member 11 and the first weight sensor 31 may be disposed in the first member support 11*s*. Specifically, the first member support 11*s* supporting the first member 11 is disposed on the bottom surface side of the first member 11 which is disposed to turn about the first turning shaft 21. Since one end of the first member support 11*s* is connected to the first member 11 and the other end thereof comes in contact with the scanner body 2 to face the turning direction of the first member 11 due to the weight of the first member 11, the first member support 11*s* regulates the turning of the first member 11 and supports the first member 11. By disposing the first weight sensor 31 in a portion of the first member support 11*s* coming in contact with the scanner body 2, the first weight sensor 31 may detect a force in the turning direction of the first member 11 and detect the weight of the documents S mounted on the mounting surface 15 using the force in the turning direction.

The feed mechanism 40 is provided with a bias spring 46 that applies a force in a direction in which the separation member 45 is pressed against the pickup roller 41 to the separation member 45 when the separation member 45 is separated from the pickup roller 41. The bias spring 46 is formed of a compression spring and is disposed on the surface side of the separation member 45 opposite to the side on which the pickup roller 41 is located. Accordingly, the bias spring 46 can apply a force in the direction in which the separation member 45 is pressed against the pickup roller 41 to the separation member 45.

A document sensor 48 as a document detecting unit configured to detect presence of a document S, is disposed downstream from the feed mechanism 40 in the feeding direction of the documents S in the feed mechanism 40. The document sensor 48 can come in contact with a document S which is fed from the feed mechanism 40 to the image reading unit 60 to detect the document S. The document sensor 48 may detect the document S using a technique other than a direct contact with the document S and may detect the document S, for example, using infrared rays.

Figure 3:
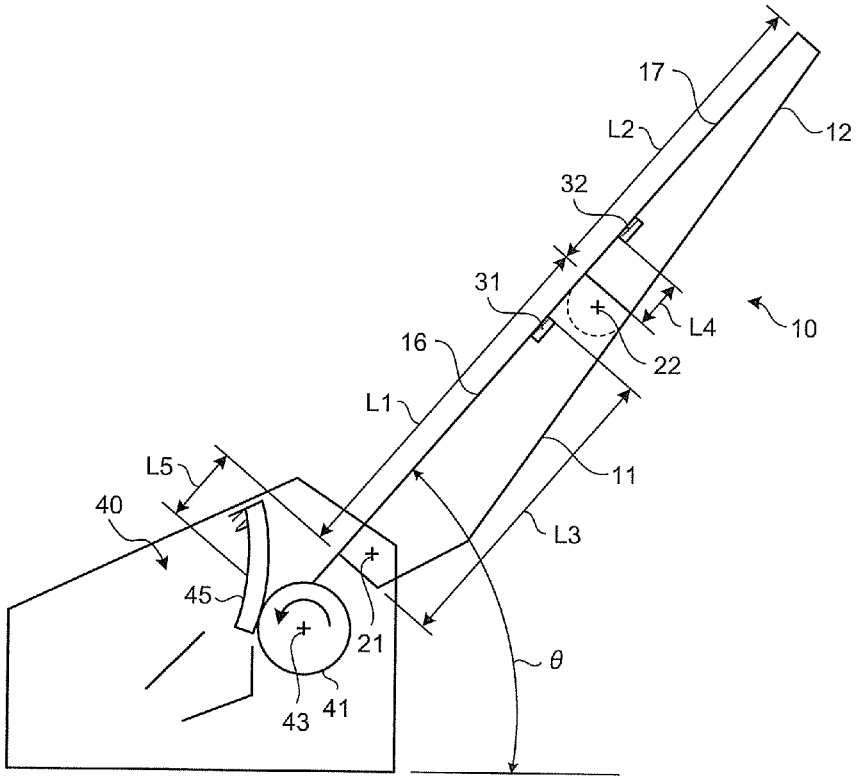
FIG. 3 is a diagram illustrating a positional relationship of constituent units of the document mounting board illustrated in FIG. 1.

FIG. 3 is a diagram illustrating a positional relationship of constituent units of the document mounting board illustrated in FIG. 1. As the positional relationship of the constituent units of the document mounting board 10, the document mounting board 10 and the feed mechanism 40, when the size of the documents S is an A4 size and the documents S are fed in the length direction of A4, will be described. First, it is preferable that an inclination angle θ of the document mounting board 10, that is, an inclination angle θ of the first mounting surface 16 of the first member 11 inclined to decrease the height in the feeding direction, be about 50° such that the mounted documents S move appropriately toward the feed mechanism 40 with its own weight. That is, it is preferable that the first member support 11*s* (see FIG. 2) be disposed as a position at which the inclination angle θ of the first mounting surface 16 is about 50°, to regulate the turning of the first member 11.

It is preferable that the length of the first member 11 in the feeding direction of the documents S be set to a length with which the position of the end of the first member 11 on the second member 12 side is located above the position of the center in the feeding direction of the maximum size documents S mounted on the document mounting board 10. For example, when a distance L5 between the end of the first member 11 on the pickup roller 41 side and the rotation shaft 43 of the pickup roller 41 is, for example, 50 mm, it is preferable that the length L1 of the first member 11 in the feeding direction of the documents S be about 130 mm. That is, since the length of A4 in the length direction is 297 mm, it is preferable that the length L1 of the first member 11 be set to a length slightly larger than 98.5 mm which is obtained by subtracting 50 mm from 148.5 mm which is a half of 297 mm, for example, about 130 mm.

It is preferable that the length L2 of the second member 12 in the feeding direction of the document S be set to a length with which the position of the end of the second member 12 opposite to the end on the first member 11 side is located in the vicinity of the upper end of the documents S with the maximum size mounted on the document mounting board 10, for example, the length L2 be about 120 mm. Accordingly, when the distance L5 to the rotation shaft 43 of the pickup roller 41 is 50 mm and the length L1 of the first member 11 is 130 mm, 50 mm+130 mm+120 mm=300 mm is established and the length from the position in the vicinity of the rotation shaft 43 of the pickup roller 41 to the downstream end of the second member 12 is substantially equal to the length of A4 (297 mm).

When the first weight sensor 31 is disposed at the position in contact with the first mounting surface 16, it is preferable that the first weight sensor 31 be disposed in the vicinity of the end of the first member 11 on the second member 12 side. For example, when the length L1 of the first member 11 is 130 mm, it is preferable that the first weight sensor 31 be disposed at a position at which the length L3 from the end of the first member 11 on the pickup roller 41 side is about 110 mm. Similarly, it is preferable that the second weight sensor 32 be disposed in the vicinity of the end of the second member 12 on the first member 11 side. It is preferable that the second weight sensor 32 be disposed at a position at which the length L4 from the end of the second member 12 on the first member 11 side is about 20 mm.

Figure 4:
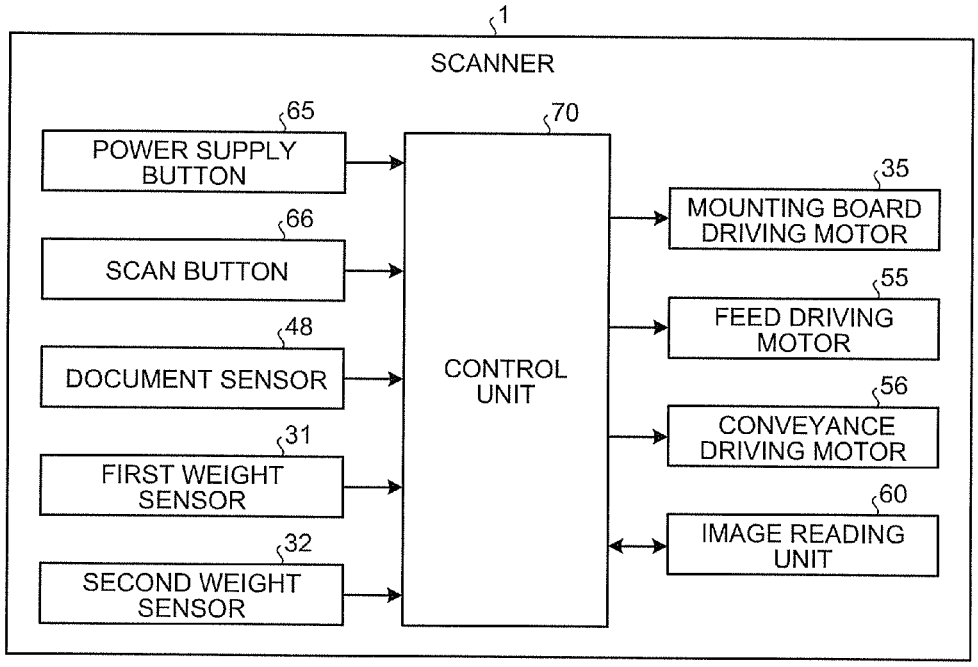
FIG. 4 is a functional block diagram of the scanner including the sheet feeding device according to the embodiment.

FIG. 4 is a functional block diagram of a scanner including the sheet feeding device according to the embodiment. The scanner 1 includes a control unit 70 configured to control the constituent units of the scanner 1. The hardware configuration of the control unit 70 includes a central processing unit (CPU), a graphic processing unit (GPU), a digital signal processor (DSP), a large scale integrated circuit (LSI), an application specific integrated circuit (ASIC), and/or a field-programming gate array (FPGA), functioning as the material controller that mainly performs operation process, or includes a control circuit. The control unit 70 includes a random access memory (RAM) and a read only memory (ROM) that sore programs or information, a fixed disk drive such as a hard disk drive, a solid state drive (SSD), and/or an optical disk, storing various kinds of information, and the like. In addition, The control unit 70 includes an input/output interface, and the hardware configuration of the control unit 70 is the same as a conventional personal computer or a scanner device and thus detailed description thereof will not be made. The mounting board driving motor 35 and the feed driving motor 55 are electrically connected to the control unit 70 and can be controlled by the control unit 70. A conveyance driving motor 56 that generates a driving force for causing the conveyance roller 51 and the discharge roller 52 to rotate, is also electrically connected to the control unit 70 and can be controlled by the control unit 70.

The document sensor 48, the first weight sensor 31, and the second weight sensor 32 are also electrically connected to the control unit 70 and detection results of the sensors can be transmitted to the control unit 70 and be acquired by the control unit 70. The image reading unit 60 is electrically connected to the control unit 70 and can be controlled by the control unit 70 and image data read by the image reading unit 60 can be transmitted to the control unit 70.

The scanner 1 includes a power supply button 65 that switches ON and OFF of a power supply and a scan button 66 that causes the scanner 1 to start scanning, and these buttons are also electrically connected to the control unit 70. The power supply button 65 and the scan button 66 are disposed on the surface of the scanner 1 and can be operated by a user of the scanner 1.

The sheet feeding device 5 according to this embodiment has the above-mentioned configuration and operations thereof will be described below. When an image of a document S is read by the scanner 1, the document S is mounted on the document mounting board 10. The document mounting board 10 is inclined from up to down from the upstream side to the downstream side in the feeding direction of a document S in the feed mechanism 40, the document S mounted on the mounting surface 15 of the document mounting board 10 moves downstream in the feeding direction with its own weight. Accordingly, the leading edge of the document S in the feeding direction reaches the position of the feed mechanism 40 and comes in contact with the outer circumferential surface in the vicinity of the upper end of the pickup roller 41 from the upper side of the pickup roller 41.

When the pickup roller 41 rotates in this state, the document S moves downstream in the feeding direction which is a moving direction of the vicinity of the upper end of the pickup roller 41 by a frictional force with the pickup roller 41 and is fed to the conveyance roller 51. An image of the document S fed to the conveyance roller 51 is read by the image reading unit 60 and the document is conveyed to the discharge port 3 by the conveyance roller 51 or the discharge roller 52. The image read by the image reading unit 60 is transmitted to the control unit 70 and is properly stored in the control unit 70, and the document S conveyed to the discharge port 3 is discharged from the discharge port 3.

Figure 5:
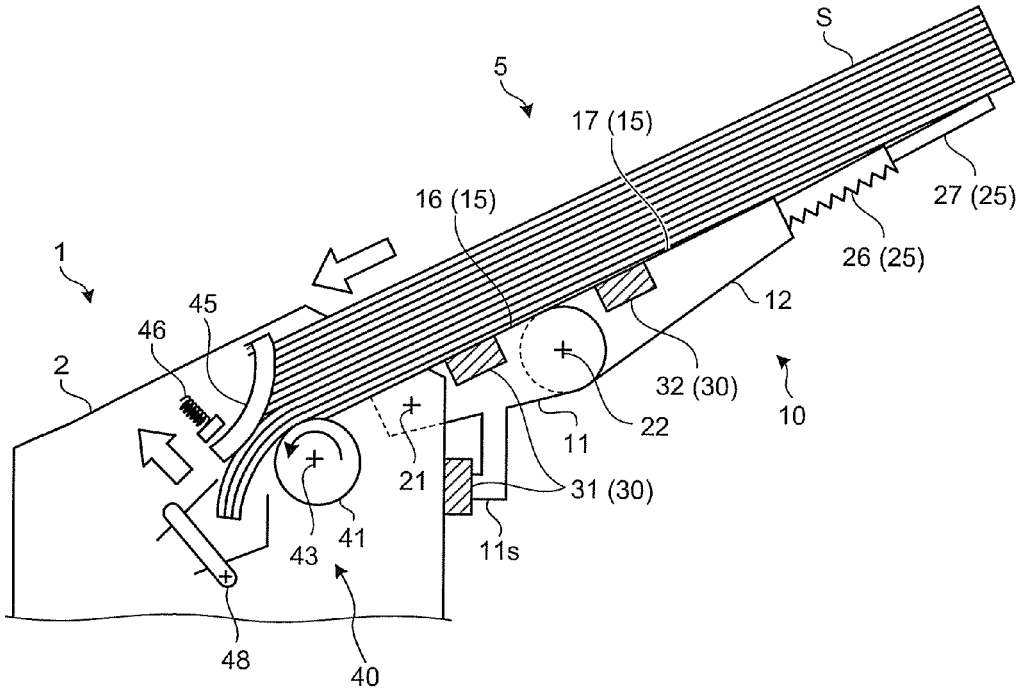
FIG. 5 is a diagram illustrating a state in which overlap feeding occurs at the time of reading a plurality of documents.

FIG. 5 is a diagram illustrating a state in which overlap feeding occurs when a plurality of documents are read. When images of a plurality of documents S are read by the scanner 1, a bundle of documents S including the plurality of documents S is mounted on the mounting surface 15 of the document mounting board 10. In this case, the bundle of documents S as a whole moves to the feed mechanism 40 with its own weight and the bottom surface of the document S located at the lowermost comes in contact with the outer circumferential surface of the pickup roller 41. When the pickup roller 41 rotates in this state, the document S in contact with the pickup roller 41 is fed downstream in the feeding direction by the frictional force with the pickup roller 41.

Here, since the documents S are mounted on the inclined mounting surface 15 of the document mounting board 10, a force in the moving direction to the feed mechanism 40 is generated with its own weight, but this direction is the same direction as the feeding direction in which the documents S are fed by the feed mechanism 40. When the lowermost document S is fed downstream in the feeding direction in a state in which the plurality of documents S overlap and are mounted on the document mounting board 10, the force in the moving direction downstream in the feeding direction is transmitted to the documents S stacked on the lowermost document S by the frictional force between the documents S. Accordingly, a large force in the moving direction downstream in the feeding direction is generated in the documents S other than the lowermost document S and this force is applied to the separation member 45 as a pressing force against the separation member 45.

The separation member 45 can forward only one document to the image reading unit 60 by regulating movement of the documents S other than the document S in contact with the pickup roller 41, but the separation member 45 has elasticity and thus is bent to get apart from the pickup roller 41 by a large force when the large force is applied thereto. When the separation member 45 is greatly bent, a large gap is formed between the separation member 45 and the pickup roller 41 and thus the separation member 45 has difficulty in regulating movement of the documents S other than the document S in contact with the pickup roller 41. In this case, two or more documents S are fed downstream in the feeding direction and so-called overlap feeding occurs, thereby causing a paper jam or the like.

Figure 6:
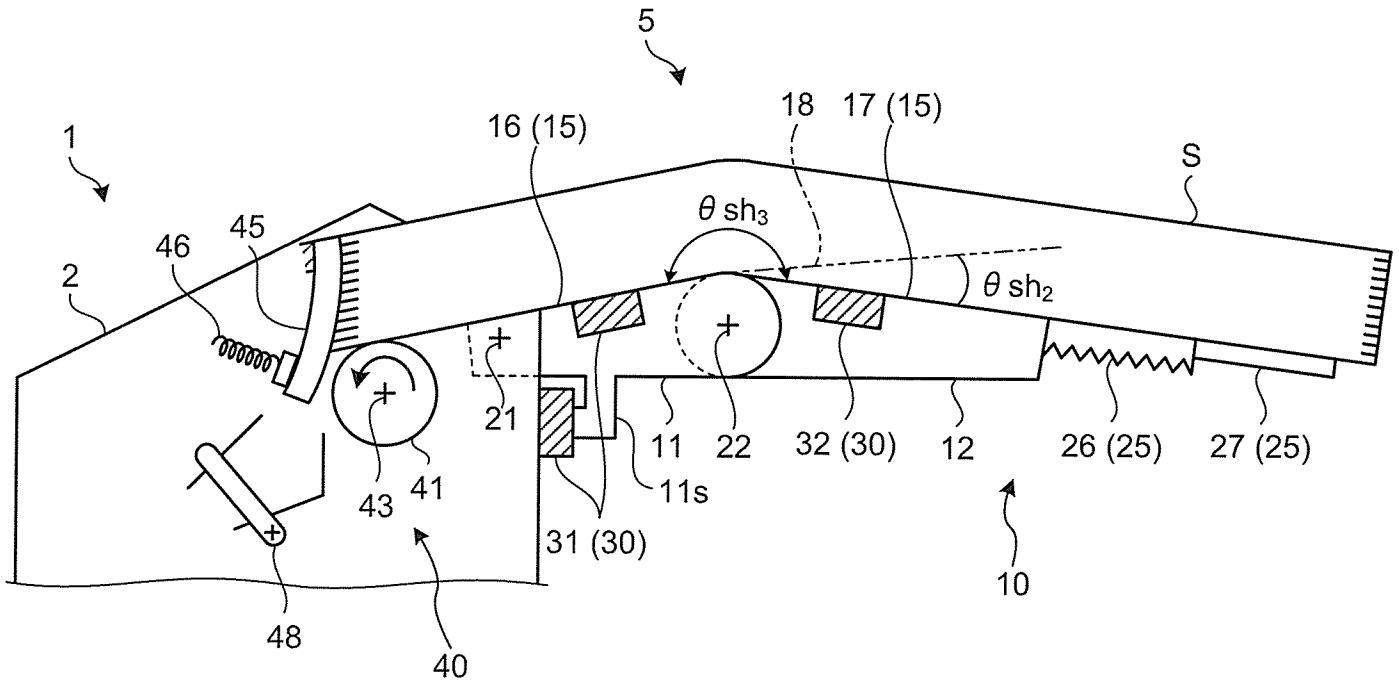
FIG. 6 is a diagram illustrating a state in which overlap feeding is avoided.

FIG. 6 is a diagram illustrating a state in which overlap feeding is avoided. In the sheet feeding device 5 according to this embodiment, the second member 12 turns about the second turning shaft 22 with the weight of the documents S detected by the weight sensor 30 and the angle of the second member 12 with respect to the first member 11 is changed, whereby the overlap feeding of the documents S is avoided. That is, the overlap feeding of the documents S easily occurs due to the large weight of the documents S as a whole mounted on the document mounting board 10. Accordingly, when the weight of the documents S detected by the weight sensor 30 is large, the second member 12 turns such that the weight of the documents S is not easily applied to the separation member 45.

Specifically, the second member 12 turns about the second turning shaft 22 to be separated apart downward from a virtual plane 18 which is formed by extending the first mounting surface 16 to the second member 12. That is, the second member 12 turns about the second turning shaft 22 such that the second mounting surface 17 which is inclined downward to the downstream side in the feeding direction gets close to a horizontal plane or the upstream side in the feeding direction is lower than the downstream side. In this case, the documents S are slowly bent such that parts of the documents S mounted on the second mounting surface 17 have the same inclination angle as the second mounting surface 17.

Accordingly, a ratio of the weight of the parts of the documents S mounted on the second mounting surface 17 and applied to the second mounting surface 17 increases and a ratio of the weight applied to the separation member 45 decreases. As a result, the weight of the documents S applied to the separation member 45 decreases and the pressing force against the separation member 45, which is applied from the documents S to the separation member 45 with the total weight of the documents S decreases. Accordingly, since the separation member 45 is not easily bent, a large gap is not easily formed between the separation member 45 and the pickup roller 41, and two or more documents S are not easily fed through the gap between the separation member 45 and the pickup roller 41, whereby the overlap feeding of the documents S is avoided.

Figure 7:
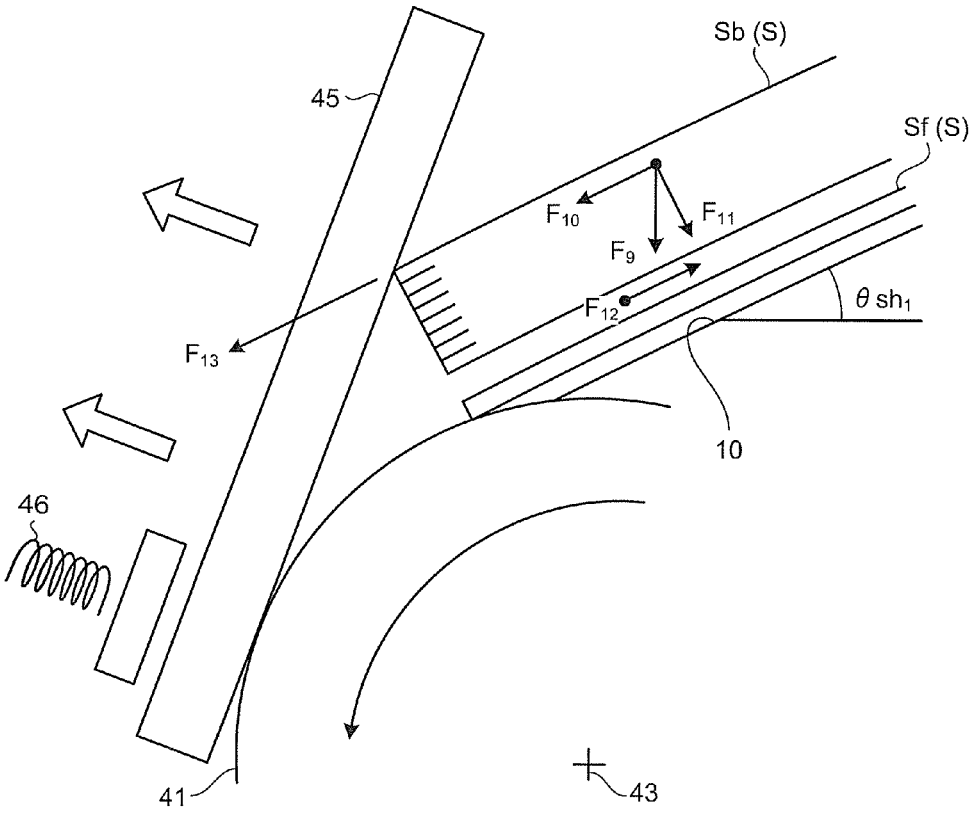
FIG. 7 is a diagram illustrating a pressing force applied from documents to a separation member.

FIG. 7 is a diagram illustrating a pressing force applied from the documents to the separation member. The pressing force applied from the documents S mounted on the document mounting board 10 to the separation member 45 will be described below. In the description, it is assumed that among the documents S mounted on the document mounting board 10, one document S which comes in contact with the pickup roller 41 and is fed by the pickup roller 41, is referred to as a feeding document Sf, and the documents S other than the feeding document Sf and stacked on the feeding document Sf, are referred to as a bundle of documents Sb. In this case, a force $F_9$ acting in the vertical direction with the weight of the bundle of documents Sb is calculated by using Equation (1) from mass M and gravitational acceleration g of the bundle of documents Sb.

$$F_9=M\times g \tag{1}$$

Since the document mounting board 10 is inclined such that the downstream side in the feeding direction of the documents S faces the lower side, the force $F_9$ acting in the vertical direction with the weight of the bundle of documents Sb is also inclined to both the feeding direction of the document S and the mounting direction of the documents S on the document mounting board 10. Accordingly, the force $F_9$ acting in the vertical direction can be decomposed to a force $F_{10}$ acting in the feeding direction of the document S and a force $F_{11}$ acting on the mounting direction to the document mounting board 10. The force $F_{10}$ acting in the feeding direction of the document S and the force $F_{11}$ acting on the mounting direction to the document mounting board 10, can be obtained by Equations (2) and (3), where $\theta sh_1$ denotes the inclination angle of the document mounting board 10.

$$F_{10}=F_9\times\sin\theta sh_1 \tag{2}$$

$$F_{11}=F_9\times\cos\theta sh_1 \tag{3}$$

In this way, the force $F_{11}$ acting on the mounting direction to the document mounting board 10 acts between the bundle of documents Sb and the feeding document Sf. Accordingly, when a friction coefficient therebetween is defined by $\mu_{p\text{-}p}$, a frictional force $F_{12}$ generated between the feeding document Sf and the bundle of documents Sb is expressed by Equation (4).

$$F_{12}=F_{11}\times\mu_{p\text{-}p} \tag{4}$$

Since the frictional force $F_{12}$ generated between the feeding document Sf and the bundle of documents Sb serves as resistance to the force $F_{10}$ acting in the feeding direction of the document S from the bundle of documents Sb, a force $F_{13}$ actually acting in the feeding direction from the bundle of documents Sb, that is, a pressing force $F_{13}$ acting from the documents S to the separation member 45, is expressed by Equation (5).

$$F_{13}=F_{10}-F_{12} \tag{5}$$

Figure 8:
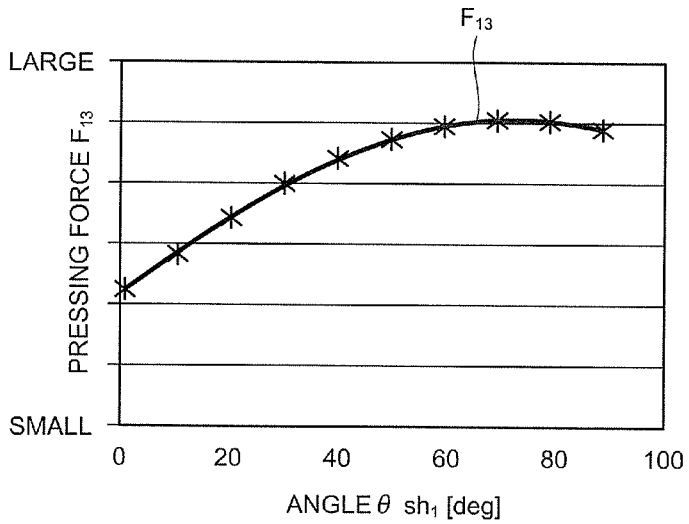
FIG. 8 is a diagram illustrating a pressing force to the separation member with respect to an inclination angle of the document mounting board.

FIG. 8 is a diagram illustrating a pressing force to the separation member with respect to the inclination angle of the document mounting board. The pressing force $F_{13}$ acting from the documents S to the separation member 45, is a force based on the force $F_{10}$ by which the documents S move in the feeding direction with its weight, but the force $F_{10}$ by which the documents move in the feeding direction is changed depending on the inclination angle $\theta sh_1$ of the document mounting board 10. That is, the force $F_{10}$ by which the documents S move in the feeding direction increases with an increase in the inclination angle $\theta sh_1$ of the document mounting board 10. Accordingly, the pressing force $F_{13}$ acting from the documents S to the separation member 45 which is a force based on the force $F_{10}$ by which the documents S move in the feeding direction, also increases with the increase in the inclination angle $\theta sh_1$ of the document mounting board 10.

However, when the inclination angle $\theta sh_1$ of the document mounting board 10 excessively decreases, the documents S do not move easily from the document mounting board 10 to the feed mechanism 40. Accordingly, in the sheet feeding device 5 according to this embodiment, the angle of the second member 12 is changed depending on the weight of the documents S.

Figure 9:
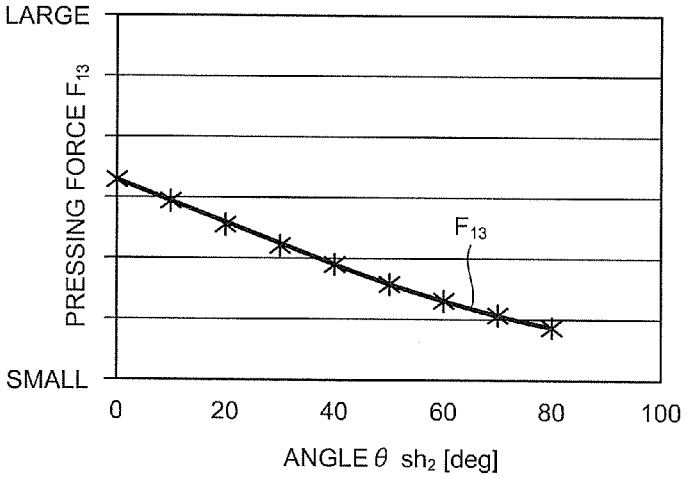
FIG. 9 is a diagram illustrating a pressing force to the separation member when an angle of a second member is changed.

FIG. 9 is a diagram illustrating a pressing force acting on the separation member when the angle of the second member is changed. When the second member 12 turns with respect to the first member 11 to be separated apart downward from the virtual plane 18 which is formed by extending the first mounting surface 16 to the second member 12 and the angle $\theta sh_2$ (see FIG. 6) of the second mounting surface 17 about the virtual plane 18 is changed, the force $F_{10}$ by which the parts of the documents S placed on the second mounting surface 17 move in the feeding direction is changed. That is, as the angle $\theta sh_2$ of the second mounting surface 17 about the virtual plane 18 increases, the force $F_{11}$ acting in the mounting direction to the document mounting board 10 with the weight of the bundle of documents Sb of the portions of the documents S placed on the second mounting surface 17, increases and the force $F_{10}$ by which the documents move in the feeding direction, decreases. Accordingly, as a whole of the documents S, the force $F_{10}$ by which the documents move in the feeding direction, decreases with an increase in the angle $\theta sh_2$ of the second mounting surface 17 about the virtual plane 18, and thus the pressing force $F_{13}$ acting from the documents S to the separation member 45, also decreases with the increase in the angle $\theta sh_2$ of the second mounting surface 17.

As can be clearly seen from Equations (1) to (5), the pressing force $F_{13}$ acting from the documents S to the separation member 45 is affected by the mass M of the documents S, that is, the weight of the documents S, and is changed by the weight of the documents S. Accordingly, in the sheet feeding device 5 according to this embodiment, the angle of the second member 12 is changed depending on the weight of the documents S and the pressing force $F_{13}$ acting from the documents S to the separation member 45 is decreased. That is, as the weight of the documents S detected by the weight sensor 30 increases, the second member 12 turns about the second turning shaft 22 to be separated apart downward from the virtual plane 18 formed by extending the first mounting surface 16 to the second member 12. Accordingly, when the weight of the documents S detected by the weight sensor 30 is large, the pressing force $F_{13}$ acting from the documents S to the separation member 45 is decreased.

In the control of changing the angle of the second member 12 depending on the weight of the documents S detected by the weight sensor 30, a threshold value for the weight capable of avoiding the overlap feeding of the documents S is set for the detected value detected by the weight sensor 30 and the angle of the second member 12 is changed with respect to the threshold value. At this time, a detected value detected by the first weight sensor 31 that detects the weight of the documents S mounted on the first mounting surface 16, which is a part having a large influence on the pressing force $F_{13}$ acting from the documents S to the separation member 45 among the weight of the documents S, is used as the detected value detected by the weight sensor 30 that detects the weight of the documents S which is compared with the threshold value.

That is, when the weight of the documents S detected by the first weight sensor 31 is less than a predetermined threshold value, the second member 12 becomes a state in which the second mounting surface 17 is flush with the first mounting surface 16. On the other hand, when the weight of the documents S detected by the first weight sensor 31 is equal to or greater than the threshold value, the second member 12 turns about the second turning shaft 22 to be separated apart downward from the virtual plane 18 formed by extending the first mounting surface 16 to the second member 12. Accordingly, when the weight of the documents S detected by the first weight sensor 31 is large and there is a possibility that the overlap feeding of the documents S will occur, the pressing force $F_{13}$ acting from the documents S to the separation member 45 is decreased to avoid the overlap feeding of the documents S.

In this way, the threshold value for the weight of the documents S detected by the first weight sensor 31, which is used to avoid the overlap feeding of the documents S, is set to gradual different magnitudes. The turning angle of the second member 12 corresponds to the gradually set threshold value and is set to gradual values to be separated apart downward as the threshold value increases. In this case, when the weight of the documents S detected by the first weight sensor 31 is less than the smallest threshold value of the gradually set threshold values, the second member 12 turns such that the second mounting surface 17 is flush with the first mounting surface 16. When the weight of the documents S detected by the first weight sensor 31 is equal to or greater than the smallest threshold value of the gradually set threshold values, the second member 12 turns by the turning angle corresponding to the threshold value which is equal to or less than the weight of the documents S and close to the weight of the documents S.

Figure 10:
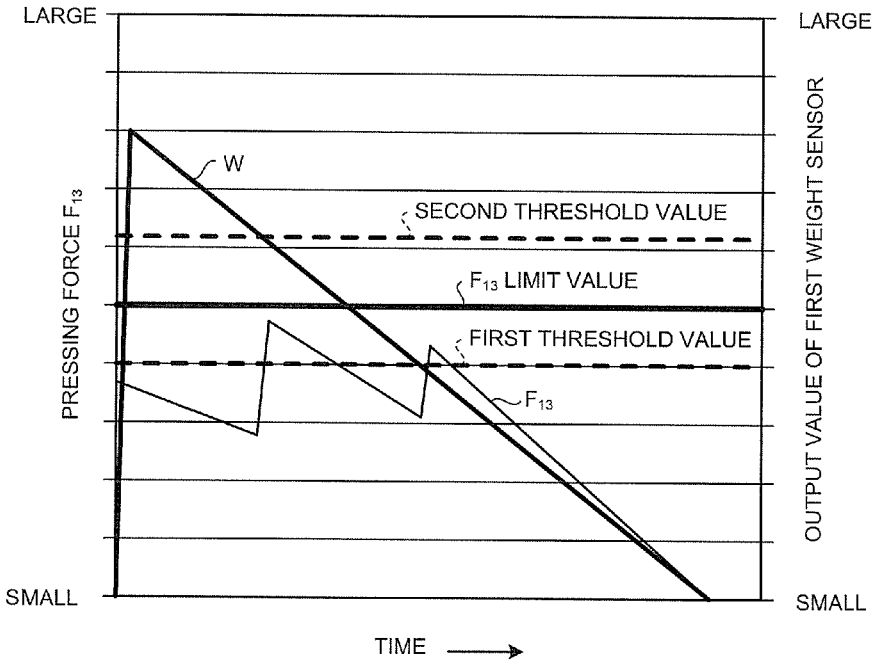
FIG. 10 is a diagram illustrating a case in which the pressing force to the separation member is decreased by turning the second member depending on a weight of documents.

FIG. 10 is a diagram illustrating a case in which the pressing force against the separation member is decreased by causing the second member to turn depending on the weight of the documents. In the sheet feeding device 5 according to this embodiment, the threshold value for the weight of the documents S is specifically set to a first threshold value and a second threshold value greater than the first threshold value, which are stored in the memory of the control unit 70. A weight corresponding to a $F_{13}$ limit value which is a limit value of the pressing force $F_{13}$, is set between the first threshold value and the second threshold value. The $F_{13}$ limit value is set to an upper limit value of the pressing force $F_{13}$ when the pressing force $F_{13}$ acting from the documents S to the separation member 45 is set to a value having a magnitude with which there is a possibility that the overlap feeding of the documents S will occur and the documents are fed without causing the overlap feeding.

The turning angle of the second member 12 is an angle $\theta sh_3$ (see FIG. 6) between the first mounting surface 16 and the second mounting surface 17 and is set to four steps of a first angle to a fourth angle, the first angle is the smallest, and the fourth angle is the largest. For example, the first angle is set to 155°, the second angle 180°, the third angle is set to 205°, and the fourth angle is set to 230°, which are stored in the memory of the control unit 70.

Regarding the relationship between the threshold value and the angle, the second angle is set as an angle when a first weight sensor output value W which is the detected value detected by the first weight sensor 31, is less than the first threshold value. The third angle is set as an angle when the first weight sensor output value W is equal to or greater than the first threshold value and less than the second threshold value. The fourth threshold value is set as an angle when the first weight sensor output value W is equal to or greater than the second threshold value. The first angle is set as an angle which is used in a non-feeding state of the documents S to be described later.

In this settings, when the first weight sensor output value W, which is the detected value of the first weight sensor 31, is less than the first threshold value, the second member 12 turns such that the angle $\theta sh_3$ between the first mounting surface 16 and the second mounting surface 17 is 180° which is the second angle. When the first weight sensor output value W is equal to or greater than the first threshold value, the angle $\theta sh_3$ between the first mounting surface 16 and the second mounting surface 17 differs depending on whether the first weight sensor output value W is less than the second threshold value or equal to, or greater than the second threshold value.

For example, when the first weight sensor output value W is less than the second threshold value, the threshold value which is equal to or less than the first weight sensor output value W and close to the first weight sensor output value W is the first threshold value. Since the turning angle corresponding to the first threshold value is the third angle, the second member 12 turns in this case such that the angle $\theta sh_3$ between the first mounting surface 16 and the second mounting surface 17 is 205° which is the third angle.

When the first weight sensor output value W is equal to or greater than the second threshold value, the threshold value which is equal to or less than the first weight sensor output value W and close to the first weight sensor output value W, is the second threshold value. Since the turning angle corresponding to the second threshold value is the fourth angle, the second member 12 turns in this case such that the angle $\theta sh_3$ between the first mounting surface 16 and the second mounting surface 17 is 230° which is the fourth angle.

Accordingly, when the first weight sensor output value W has a magnitude with which there is a possibility that the overlap feeding will occur, the second member 12 turns to decrease the pressing force $F_{13}$ acting from the documents S to the separation member 45. As a result, the pressing force $F_{13}$ acting from the documents S to the separation member 45 is less than the $F_{13}$ limit value and thus the overlap feeding of the documents S does not occur.

Figure 11:
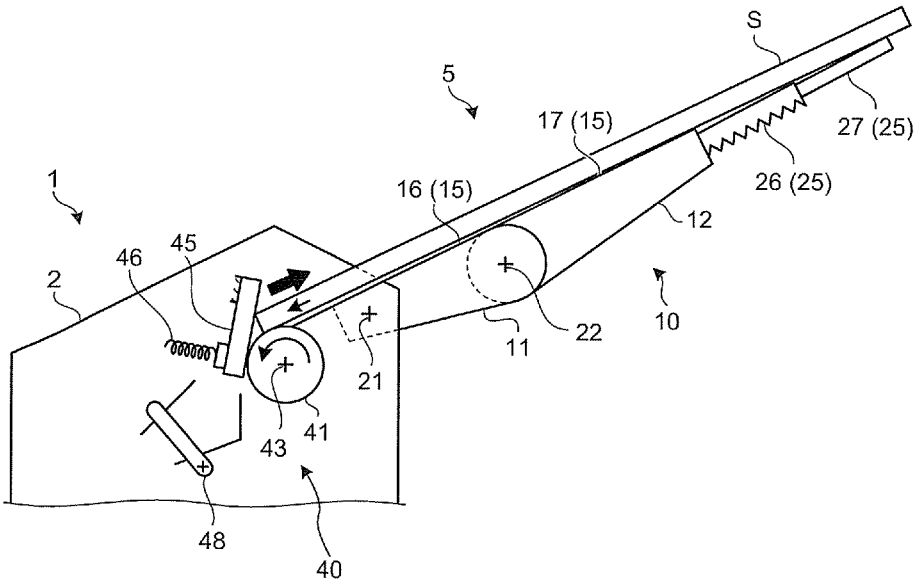
FIG. 11 is a diagram illustrating a document non-feeding state.

FIG. 11 is a diagram illustrating a document non-feeding state. When the documents S mounted on the document mounting board 10 is fed by the feed mechanism 40, sliding may be caused between the pickup roller 41 and the document S, depending on the mounting state of the documents S on the document mounting board 10 or the contact state of the documents S with the pickup roller 41, and thus the documents S may not be fed by the feed mechanism 40. In this way, when the feed mechanism 40 does not feed a document in the operation of the feed mechanism 40 feeding the documents S, a document S is not forwarded to the image reading unit 60 and thus an image of the document S cannot be read by the image reading unit 60. Accordingly, in this case, the non-feeding of the document S is released by causing the second member 12 to turn about the second turning shaft 22. That is, when non-feeding of a document S occurs, the document sensor 48 disposed downstream from the feed mechanism 40 does not detect a document S. Accordingly, when the document sensor 48 does not detect a document S in the operation of the feed mechanism 40 feeding the document, the non-feeding of a document S is released by causing the second member 12 to turn.

Figure 12:
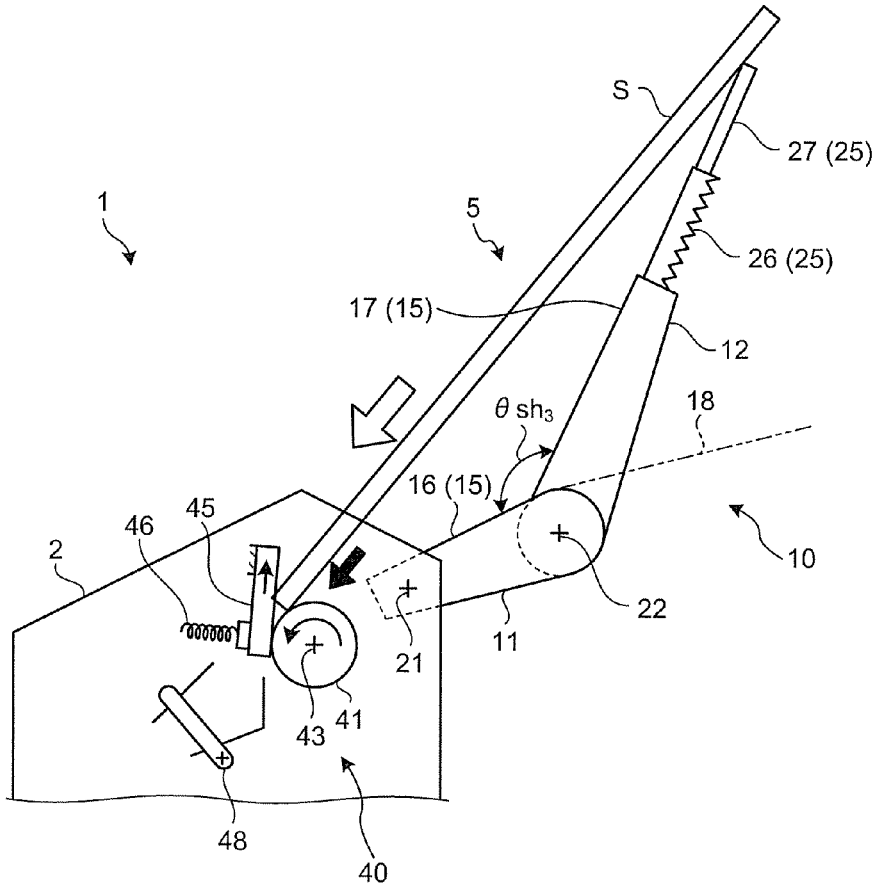
FIG. 12 is a diagram illustrating a state in which non-feeding is released.

FIG. 12 is a diagram illustrating a state in which non-feeding is released. Specifically, when the document sensor 48 does not detect a document in the operation of the feed mechanism 40 feeding a document S, the second member 12 turns about the second turning shaft 22 such that the second mounting surface 17 is located above the virtual plane 18 formed by extending the first mounting surface 16 to the second member 12. For example, regarding the turning angle of the second member 12, when the angle $\theta sh_3$ between the first mounting surface 16 and the second mounting surface 17, is the second angle which is 180°, the angle $\theta sh_3$ between the first mounting surface 16 and the second mounting surface 17, is changed to the first angle which is 155° by causing the second member to turn about the second turning shaft 22.

Accordingly, since the second member 12 is located higher toward the upstream side in the feeding direction in comparison with before the turning, the upstream ends in the feeding direction of the documents S mounted on the document mounting board 10 are located higher in comparison with before the turning. Accordingly, since the inclination angle of the documents S as a whole with respect to the horizontal direction increases, the ratio of the weight of the documents S acting in the feeding direction increases and the document S can easily move to the feed mechanism 40 by the force acting in the feeding direction. Accordingly, the document S is fed downstream by the feed mechanism 40 and the non-feeding is released.

Figure 13:
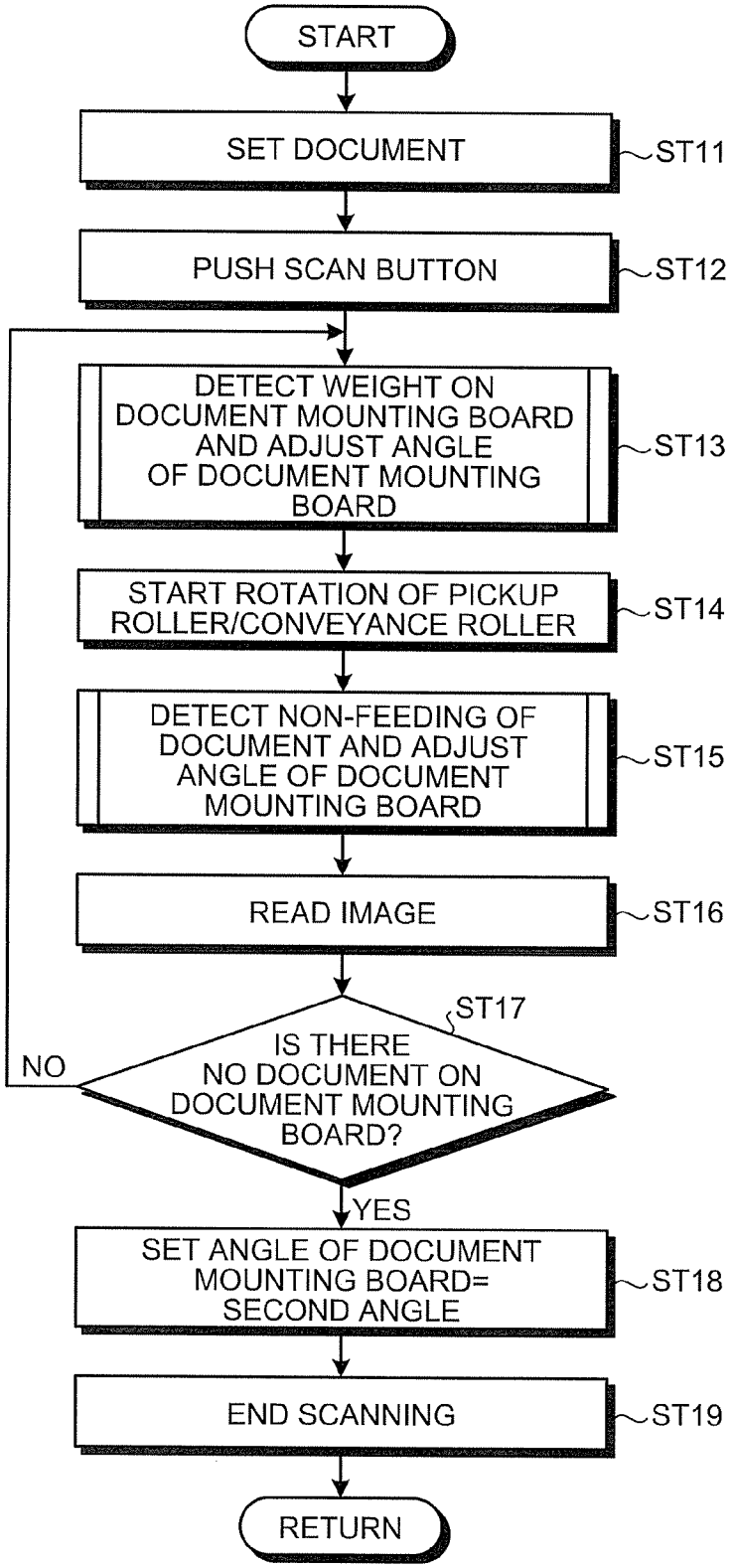
FIG. 13 is a flow diagram illustrating a processing sequence when an image of a document is read with the scanner including the sheet feeding device according to the embodiment.

FIG. 13 is a flow diagram illustrating a processing sequence when an image of a document is read with the scanner including the sheet feeding device according to the embodiment. When an image of a document S is read with the scanner 1 including the sheet feeding device 5 according to this embodiment, a document S to be read is set first by mounting the document S from which an image is read on the mounting surface 15 of the document mounting board 10 (step ST11). The document mounting board 10 is normally at the second angle, that is, in a state in which the angle $\theta sh_3$ between the first mounting surface 16 and the second mounting surface 17 is 180° and the second mounting surface 17 is flush with the first mounting surface 16, and a user mounts documents S on the mounting surface 15 which is planar. When the documents S are mounted on the document mounting board 10, the user pushes the scan button 66 (step ST12). Accordingly, an input instruction indicating to start scanning is input to the scanner 1. When the scan button 66 is pushed, a routine of detecting the weight on the document mounting board 10 and adjusting the angle of the document mounting board 10, is called (step ST13).

Figure 14:
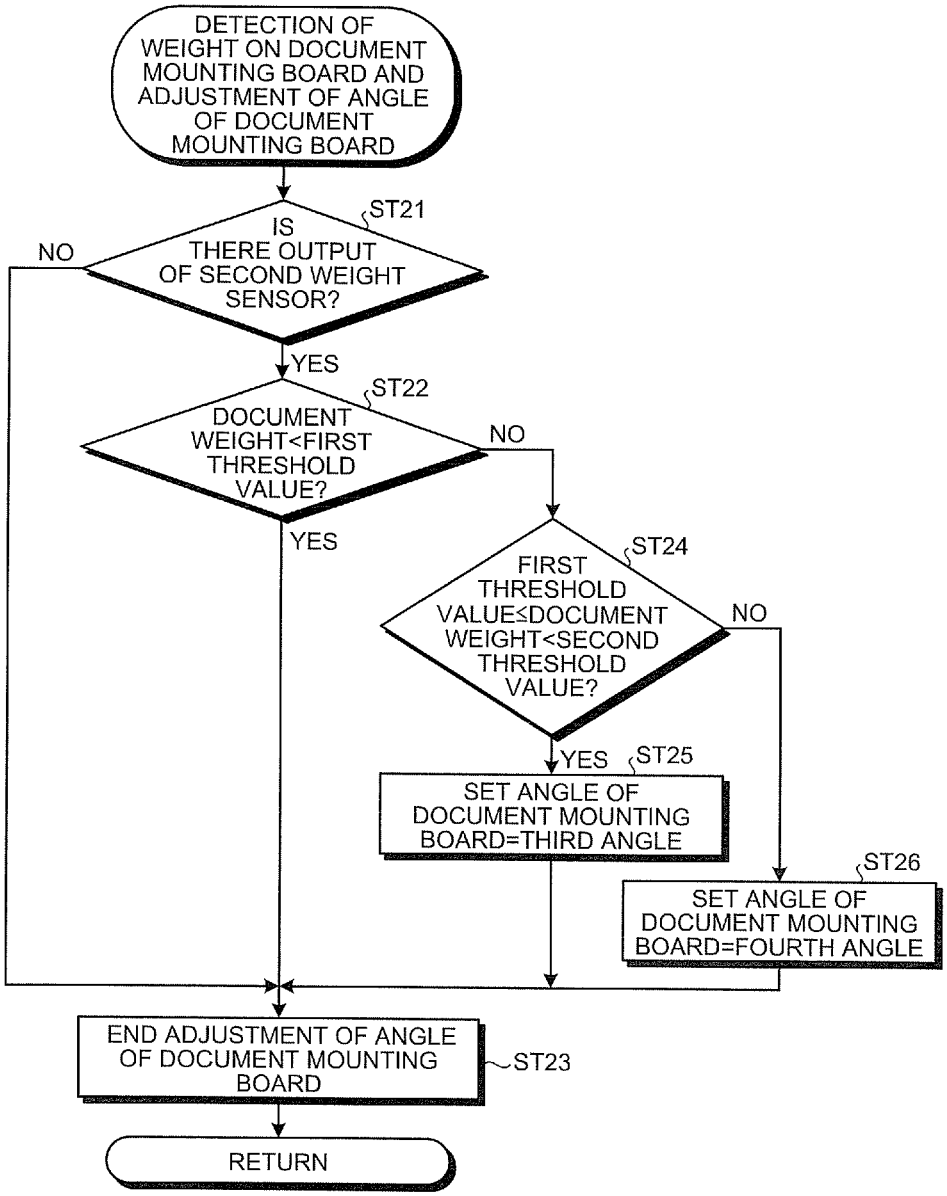
FIG. 14 is a flow diagram illustrating a processing sequence of detecting a weight on the document mounting board and adjusting an angle of the document mounting board.

FIG. 14 is a flow diagram illustrating a processing sequence of detecting the weight on the document mounting board and adjusting the angle of the document mounting board. In the routine of detecting the weight on the document mounting board 10 and adjusting the angle of the document mounting board 10, first, the control unit 70 determines whether there is an output of the second weight sensor 32 (step ST21). When it is determined that there is an output of the second weight sensor 32 (Yes determination in step ST21), it is then determined whether or not the weight of the documents S<the first threshold value is satisfied (step ST22). That is, when it is determined that there is an output of the second weight sensor 32, it means that the documents S have a size with which the documents are located on the second member 12 and that there is a possibility that overlap feeding will occur with an increase in the weight as a whole depending on the amount of the documents S. Accordingly, in this case, by comparing the output value of the first weight sensor 31 with the first threshold value, the control unit 70 determines whether or not the weight of the documents S detected by the first weight sensor 31 is less than the first threshold value.

When it is determined that the weight of the documents S detected by the first weight sensor 31 is less than the first threshold value (Yes determination in step ST22), the adjustment of the angle of the document mounting board 10 ends (step ST23) and the processing sequence departs from the routine. That is, when the weight of the documents S detected by the first weight sensor 31 is less than the first threshold value, it means that the documents S mounted on the document mounting board 10 have such a weight not to cause overlap feeding due to the weight of the documents S. Accordingly, in this case, the processing sequence departs from the routine without adjusting the angle of the document mounting board 10 for changing the posture of the documents S mounted on the document mounting board 10.

When it is determined in step ST21 that there is no output of the second weight sensor 32 (No determination in step ST21), similarly, the adjustment of the angle of the document mounting board 10 ends (step ST23) and the processing sequence departs from the routine. That is, when it is determined that there is no output of the second weight sensor 32, it means that the documents S have such a size not to locate the documents on the second member 12 and that the documents S have such a small size not to cause overlap feeding due to the weight of the documents S. Accordingly, in this case, the processing sequence also departs from the routine without adjusting the angle of the document mounting board 10 for changing the posture of the documents S mounted on the document mounting board 10.

On the other hand, when it is determined that the weight of the documents S detected by the first weight sensor 31 is equal to or greater than the first threshold value (No determination in step ST22), it is then determined whether the first threshold value≤the weight of the documents<the second threshold value is satisfied (step ST24). That is, when it is determined that the weight of the documents S detected by the first weight sensor 31 is equal to or greater than the first threshold value, it means that the documents have such a weight to cause overlap feeding due to the weight of the documents S. Accordingly, in this case, the control unit 70 newly determines the weight of the documents S to adjust the angle based on the weight of the documents S.

When it is determined that the weight of the documents S detected by the first weight sensor 31 is equal to or greater than the first threshold value and less than the second threshold value (Yes determination in step ST24), the angle in the document mounting board 10 is set to the third angle (step ST25). That is, the control unit 70 controls the mounting board driving motor 35 to activate the mounting board driving motor 35 and transmits a driving force generated by the mounting board driving motor 35 to the second member 12 to cause the second member 12 to turn about the second turning shaft 22. Accordingly, the angle $\theta sh_3$ between the first mounting surface 16 and the second mounting surface 17 is set to the third angle which is 205° to decrease the pressing force $F_{13}$ acting from the documents S to the separation member 45, thereby making it difficult to cause the overlap feeding of the documents S. When the angle in the document mounting board 10 is set to the third angle, the adjustment of the angle of the document mounting board 10 ends (step ST23) and the processing sequence departs from the routine.

On the other hand, when it is determined that the first threshold value≤the weight of the documents<the second threshold value is not satisfied (No determination in step ST24), that is, when it is determined that the weight of the documents S detected by the first weight sensor 31 is equal or greater than the second threshold value, the angle in the document mounting board 10 is set to the fourth angle (step ST26). That is, when it is determined that the weight of the documents S detected by the first weight sensor 31 is equal to or greater than the second threshold value, it means that the documents S have such a large weight to cause a high possibility that overlap feeding will occur due to the weight. Accordingly, in this case, by setting the angle $\theta sh_3$ between the first mounting surface 16 and the second mounting surface 17 to the fourth angle which is 230°, the ratio of the weight of the documents S serving as the pressing force $F_{13}$ acting from the documents S to the separation member 45 is further decreased, thereby making it difficult to cause the overlap feeding of the documents S. When the angle in the document mounting board 10 is set to the fourth angle, the adjustment of the angle of the document mounting board 10 ends (step ST23) and the processing sequence departs from the routine.

As a result, the angle $\theta sh_3$ between the first mounting surface 16 and the second mounting surface 17 is maintained at the second angle when the weight of the documents S detected by the first weight sensor 31 is less than the first threshold value, the angle $\theta sh_3$ is set to the third angle when the weight of the documents S is equal to or greater than the first threshold value and less than the second threshold value, and the angle $\theta sh_3$ is set to the fourth angle when the weight of the documents S is equal to or greater than the second threshold value. In this way, when the angle $\theta sh_3$ between the first mounting surface 16 and the second mounting surface 17 is adjusted to an angle at which the overlap feeding of the documents S does not easily occur, the processing sequence is returned to the initial flow.

When the routine of detecting the weight on the document mounting board 10 and adjusting the angle of the document mounting board 10 (step ST13) is completed, rotations of the pickup roller 41 and the conveyance roller 51 are started (step ST14). That is, the control unit 70 controls the feed driving motor 55 and the conveyance driving motor 56 to be driven, whereby the pickup roller 41 and the conveyance roller 51 rotate. When the rotations of the rollers are started, the routine of detecting the non-feeding of a document S and adjusting the angle of the document mounting board 10, is called (step ST15).

Figure 15:
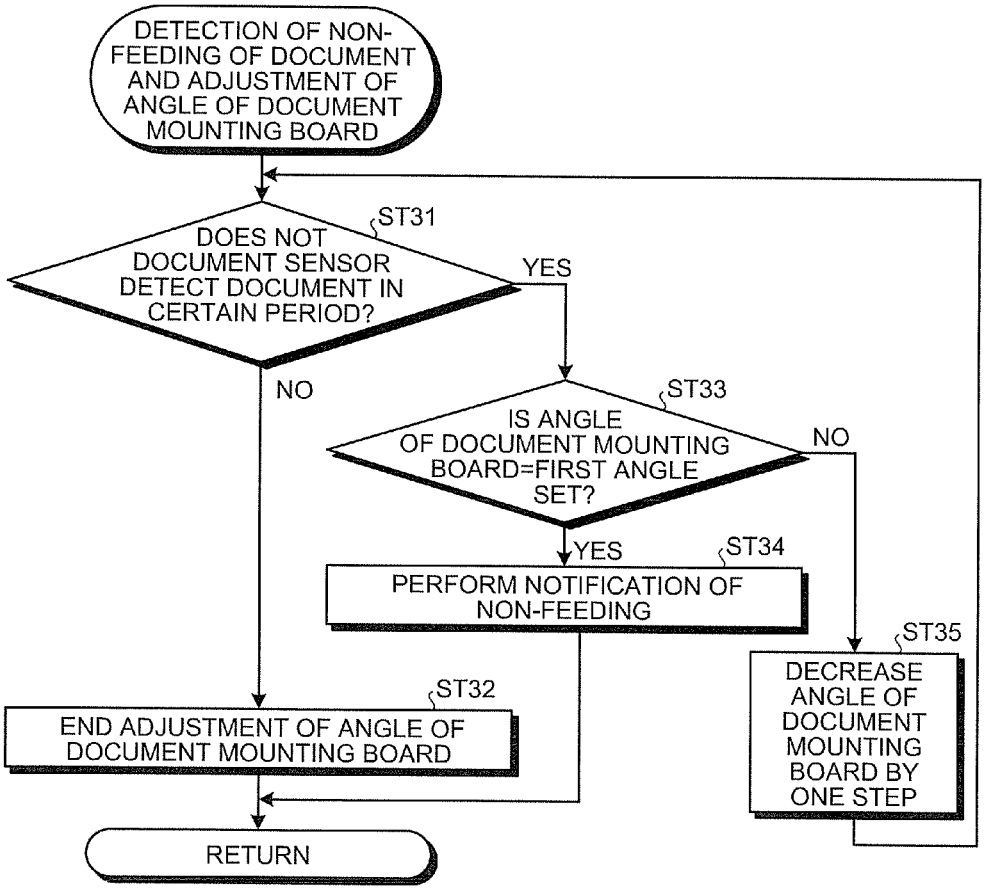
FIG. 15 is a flow diagram illustrating a processing sequence of detecting non-feeding of a document and adjusting an angle of the document mounting board.

FIG. 15 is a flow diagram illustrating a processing sequence of detecting the non-feeding of a document and adjusting the angle of the document mounting board. In the routine of detecting the non-feeding of a document S and adjusting the angle of the document mounting board 10, first, the control unit 70 determines whether the document sensor 48 does not detect a document S in a certain time (step ST31). In this case, the certain time is a time for determining whether a document S is properly fed downstream from the feed mechanism 40 in the operation of the feed mechanism 40 feeding a document and is stored in the memory of the control unit 70. That is, when the pickup roller 41 rotates, the document sensor 48 disposed downstream from the feed mechanism 40 does not detect a document S in a predetermined time, it can be determined that no document S is fed by the feed mechanism 40 and the time stored in the memory of the control unit 70 is a time for performing the determination. When the control unit 70 determines that the document sensor 48 detects a document S in the certain time (No determination in step ST31), the adjustment of the angle of the document mounting board 10 ends (step ST32) and the processing sequence departs from the routine.

On the other hand, when it is determined that the document sensor 48 does not detect a document S (Yes determination in step ST31), it is determined whether the angle in the document mounting board 10=the first angle is satisfied (step ST33). That is, the control unit 70 determines whether the angle $\theta sh_3$ between the first mounting surface 16 and the second mounting surface 17 is equal to the first angle which is 155° set as a corresponding angle when non-feeding of a document S occurs. When it is determined that the angle in the document mounting board 10 is equal to the first angle (Yes determination in step ST33), a user is notified of the non-feeding (step ST34).

Regarding the notification of non-feeding, for example, when the scanner 1 is connected to a personal computer (not illustrated), a display used in the personal computer displays a message indicating that non-feeding occurs. When the scanner 1 is provided with a display unit (not illustrated) or an indicator (not illustrated) for displaying a variety of information, the notification of non-feeding may be performed by using the display unit or the indicator. The notification of non-feeding may be performed to allow a user to visually recognize the notification or may be performed using sound such as alarm sound to allow a user to auditorily recognize the notification. When the notification of non-feeding of a document S is performed, the processing sequence departs from the routine.

On the other hand, when it is determined that the angle in the document mounting board 10 is not the first angle (No determination in step ST33), the angle of the document mounting board 10 is decreased by one step (step ST35). That is, the angle $\theta sh_3$ between the first mounting surface 16 and the second mounting surface 17 is set to four steps of the first angle to the fourth angle. Accordingly, when the angle $\theta sh_3$ is not the first angle, the angle of the document mounting board is set to an angle decreased by one step by causing the second member 12 to turn. For example, when the current angle $\theta sh_3$ is the third angle, the angle is decreased to the second angle by one step.

When the angle of the document mounting board 10 is decreased by one step, it is determined again in step ST31 whether the document sensor 48 does not detect a document S in the certain time. The routine of detecting the non-feeding of a document S and adjusting the angle of the document mounting board 10 is repeatedly performed in this way until it is determined that a document S is not non-feeding (No in step ST31) or the notification of non-feeding of a document S is performed (step ST34). When it is determined that non-feeding does not occur or the notification of non-feeding is performed, the processing sequence departs from the routine and is returned to the initial flow.

When the routine of detecting the non-feeding of a document S and adjusting the angle of the document mounting board 10 (step ST15) is completed, an image of the document S forwarded to the position of the image reading unit 60 by the pickup roller 41 and the conveyance roller 51 is read by the image reading unit 60 (step ST16). The image read by the image reading unit 60 is transmitted to the control unit 70 and is stored in the memory, or is transmitted to the personal computer and is stored in the personal computer.

Then, it is determined whether there is no document S on the document mounting board 10 (step ST17). This determination is performed on the basis of the detection result of the first weight sensor 31 by the control unit 70. When the control unit 70 determines that a document S is on the document mounting board 10 (No determination in step ST17), the routine of detecting the weight on the document mounting board 10 and adjusting the angle of the document mounting board 10 is called again in step ST13. That is, when a plurality of documents S are mounted on the document mounting board 10 and images of the documents S are read, the number of documents S on the document mounting board 10 decreases and the weight of the documents S decreases with the progress of reading. Accordingly, when it is determined that an document S is on the document mounting board 10, the routine of detecting the weight on the document mounting board 10 and adjusting the angle of the document mounting board 10 is called to repeat the above-mentioned control in this way such that the angle of the second member 12 gets close to the second angle which is an initial angle with the decrease in the number of documents S. Accordingly, feeding ability of documents S in the feed mechanism 40 can be secured and the pressing force $F_{13}$ acting from the documents S to the separation member 45 does not exceed the $F_{13}$ limit value (see FIG. 10).

On the other hand, when it is determined that no document S is on the document mounting board 10 (Yes determination in step ST17), the angle in the document mounting board 10 is set to the second angle (step ST18). That is, the control unit 70 controls the mounting board driving motor 35 such that the turning angle of the second member 12 is set to a turning angle at which the angle in the document mounting board 10 is the second angle as an initial angle. That is, the turning of the second member 12 is controlled such that angle $\theta sh_3$ between the first mounting surface 16 and the second mounting surface 17 is 180° and the second mounting surface 17 is flush with the first mounting surface 16.

When the angle in the document mounting board 10 is set to the second angle, the scanning by the scanner 1 ends (step ST19). That is, the feed driving motor 55 and the conveyance driving motor 56 are stopped to stop the pickup roller 41 and the conveyance roller 51 and the constituent units operating at the time of scanning are stopped, and next scanning is waited for in a state in which the angle in the document mounting board 10 is set to the second angle.

In the sheet feeding device 5 according to the above-mentioned embodiment, the document mounting board 10 is constituted by the first member 11 and the second member 12, and the second member 12 is made to turn depending on the weight of the documents S detected by the weight sensor 30 to change the angle with respect to the first member 11, whereby the pressing force $F_{13}$ acting from the documents S mounted on the document mounting board 10 to the separation member 45 is changed. Accordingly, it is possible to prevent a plurality of documents S from moving downstream through between the separation member 45 and the pickup roller 41 by greatly bending the separation member 45 due to an excessive increase in the pressing force $F_{13}$ acting from the documents S to the separation member 45. As a result, it is possible to prevent overlap feeding of documents S from occurring.

When the weight of the documents S is less than a predetermined first threshold value, the second mounting surface 17 of the second member 12 is flush with the first mounting surface 16 and it is thus possible to secure mounting ability of documents S on the document mounting board 10. When the weight of the documents S is equal to or greater than the first threshold value, the second member 12 turns to be separated apart downward from the virtual plane 18 formed by extending the first mounting surface 16 to the second member 12. Accordingly, when a bundle of documents S is relatively heavy, it is possible to prevent the weight of the bundle of documents S from acting on the separation member 45. Accordingly, it is possible to more satisfactorily prevent the pressing force $F_{13}$ acting from the documents S to the separation member 45 from increasing excessively. When the weight of the documents S is equal to or greater than the first threshold value, the first member 11 does not turn and only the second member 12 turns. Accordingly, it is possible to decrease the pressing force $F_{13}$ while maintaining a contact angle of the documents S with the feed mechanism 40. Accordingly, it is possible to maintain feeding ability of a document S in the feed mechanism 40. As a result, it is possible to prevent overlap feeding of documents S from occurring while maintaining mounting ability of documents S on the document mounting board 10 or feeding ability of documents S in the feed mechanism 40.

The threshold value for the weight of the documents S and the turning angle of the second member 12 are set to gradual values. When the weight of the documents S is less than the smallest threshold value of the gradually set threshold values, the second member 12 becomes a state in which the second mounting surface 17 is flush with the first mounting surface 16 and thus the documents S can move smoothly to the feed mechanism 40. When the weight of the documents S is equal to or greater than the smallest threshold value of the gradually set threshold values, the second member 12 turns by the turning angle corresponding to the threshold value which is equal to or less than the detected weight of the documents S and close to the weight of the documents S and thus it is possible to properly reduce the weight of the bundle of documents S acting on the separation member 45 without excessively turning the second member 12. As a result, it is possible to secure mobility of the documents S from the document mounting board 10 to the feed mechanism 40 and to prevent overlap feeding of documents S from occurring.

The second member 12 turns to be separated apart downward from the virtual plane 18 as the weight of the documents S detected by the weight sensor 30 increases. Accordingly, the weight of the documents S acting on the separation member 45 can be more properly decreased depending on the weight of the documents S mounted on the document mounting board 10. As a result, it is possible to more satisfactorily prevent overlap feeding of documents S depending on the weight of the documents S from occurring.

When the document sensor 48 does not detect a document S in the operation of the feed mechanism 40 feeding a document S, the second member 12 turns such that the second mounting surface 17 is located above the virtual plane 18 formed by extending the first mounting surface 16 to the second member 12 and thus the documents S mounted on the document mounting board 10 can be more easily moved to the feed mechanism 40. As a result, when non-feeding of a document S occurs, the non-feeding can be released.

Modified Example

In the sheet feeding device 5 according to the embodiment, the threshold value for the weight of the documents S which is used to determine the turning angle of the second member 12 includes two steps of the first threshold value and the second threshold value, but the number of threshold values may be other than two steps. The threshold value for the documents S may be set to one step and it may be determined whether to turn the second member 12 depending on whether the detected weight is equal to or greater than the threshold value, or the threshold value may be set to three steps or more and the turning angle of the second member 12 may be determined depending on the weight of the documents S. That is, in the sheet feeding device 5 according to the embodiment, the turning angle of the second member 12 is set to fourth steps including the first angle which is an angle in a non-feeding state, but when the threshold value is set to be other than two steps, the turning angle may be set to be other than four steps. In the sheet feeding device 5 according to the embodiment, the angle $\theta sh_3$ between the first mounting surface 16 and the second mounting surface 17 may be set to angles other than 155°, 180°, 205°, and 230°.

The second member 12 may be configured to turn continuously instead of turning to a predetermined number of steps of turning angles. In this case, the second member 12 turns continuously depending on the weight of the documents S detected by the weight sensor 30. In this way, when the turning angle of the second member 12 is continuous, the control may be continuously performed regardless of the weight of the documents S mounted on the document mounting board 10, or the threshold value for the weight of the documents S may be set and the second member 12 may be made to turn continuously depending on the detected value of the weight sensor 30 when the detected value of the weight sensor 30 is equal to or greater than the threshold value. In this way, by setting the turning angle of the second member 12 to be continuous, control can be more properly performed to cause overlap feeding not to occur depending on the weight of the documents S.

The dimensions such as the lengths of the first member 11 and the second member 12 of the document mounting board 10 or the arrangement position of the weight sensor 30 may not be equal to the dimensions described in the above-mentioned embodiment. It is preferable that the dimensions be set depending on the size of the document S to be read by the scanner 1 or the allowable number of documents S mounted on the document mounting board 10.

The sheet feeding device according to the present disclosure can prevent overlap feeding of documents from occurring.

All examples and conditional language recited herein are intended for pedagogical purposes of aiding the reader in understanding the disclosure and the concepts contributed by the inventor to further the art, and are not to be construed as limitations to such specifically recited examples and conditions, nor does the organization of such examples in the specification relate to a showing of the superiority and inferiority of the disclosure. Although the embodiments of the present disclosure have been described in detail, it should be understood that the various changes, substitutions, and alterations could be made hereto without departing from the spirit and scope of the disclosure.

What is claimed is:

1. A sheet feeding device comprising:

a document mounting board configured to have documents mounted thereon;

a document weight detecting unit configured to detect a weight of the documents mounted on the document mounting board; and a feed mechanism configured to include a pickup roller rotating to forward the documents and to feed the document at the lowermost among the documents mounted on the document mounting board to a downstream side in a feeding direction of the documents, wherein the document mounting board includes a first member that includes a first mounting surface on which the documents are mounted and that is located on the feed mechanism side in the feeding direction of the documents in the feed mechanism, the first mounting surface being inclined to a lower side toward the feed mechanism, and a second member that includes a second mounting surface on which the documents are mounted and that is disposed on a side opposite to the side of the first member on which the feed mechanism is located, and the second member is connected to the first member to be rotatable about a turning shaft parallel to a rotation shaft of the pickup roller, becomes a state in which the second mounting surface is flush with the first mounting surface, when the weight of the documents detected by the document weight detecting unit is less than a predetermined threshold value, and turns about the turning shaft to get farther downward from a plane which is formed by extending the first mounting surface to the second member, when the weight of the documents detected by the document weight detecting unit is equal to or greater than the threshold value.

2. The sheet feeding device according to claim 1, wherein the threshold value is set to gradually different magnitudes, a turning angle of the second member corresponds to the gradually set threshold value and is set gradually downward with an increase in the threshold value, the second member becomes a state in which the second mounting surface is flush with the first mounting surface, when the weight of the documents detected by the document weight detecting unit is less than the smallest threshold value of the gradually set threshold values, and the second member turns, by the turning angle corresponding to the threshold value which is equal to or less than the weight of the documents and which is close to the weight of the documents, when the weight of the documents detected by the document weight detecting unit is equal to or greater than the smallest threshold value of the gradually set threshold values.

3. The sheet feeding device according to claim 1, wherein the second member turns about the turning shaft to get farther downward from a plane which is formed by extending the first mounting surface to the second member when the weight of the documents detected by the document weight detecting unit becomes larger.

4. The sheet feeding device according claim 1, further comprising a document detecting unit which is disposed downstream from the feed mechanism in the feeding direction of the documents in the feed mechanism and which is configured to detect existence of the document, wherein the second member turns about the turning shaft such that the second mounting surface is located above a plane formed by extending the first mounting surface to the second member, when the feed mechanism operates to feed the document and the document detecting unit does not detect the document.

5. A sheet feeding device comprising:

a document mounting board configured to have documents mounted thereon;

a document weight detecting unit configured to detect a weight of the documents mounted on the document mounting board; and a feed mechanism configured to include a pickup roller rotating to forward the documents and to feed the document at the lowermost among the documents mounted on the document mounting board to a downstream side in a feeding direction of the documents, wherein the document mounting board includes a first member that includes a first mounting surface on which the documents are mounted and that is located on the feed mechanism side in the feeding direction of the documents in the feed mechanism, the first mounting surface being inclined to a lower side toward the feed mechanism, and a second member that includes a second mounting surface on which the documents are mounted and that is disposed on a side opposite to the side of the first member on which the feed mechanism is located, and the second member is connected to the first member to be rotatable about a turning shaft parallel to a rotation shaft of the pickup roller, and turns about the turning shaft to get farther downward from a plane which is formed by extending the first mounting surface to the second member when the weight of the documents detected by the document weight detecting unit becomes larger.

6. A sheet feeding device comprising:

a document mounting board configured to have documents mounted thereon;

a document weight detecting unit configured to detect a weight of the documents mounted on the document mounting board;

a feed mechanism configured to include a pickup roller rotating to forward the documents and to feed the document at the lowermost among the documents mounted on the document mounting board to a downstream side in a feeding direction of the documents; and a document detecting unit which is disposed downstream from the feed mechanism in the feeding direction of the documents in the feed mechanism and which is configured to detect existence of the document, wherein the document mounting board includes a first member that includes a first mounting surface on which the documents are mounted and that is located on the feed mechanism side in the feeding direction of the documents in the feed mechanism, the first mounting surface being inclined to a lower side toward the feed mechanism, and a second member that includes a second mounting surface on which the documents are mounted and that is disposed on a side opposite to the side of the first member on which the feed mechanism is located, and the second member is connected to the first member to be rotatable about a turning shaft parallel to a rotation shaft of the pickup roller, and turns about the turning shaft such that the second mounting surface is located above a plane formed by extending the first mounting surface to the second member, when the feed mechanism operates to feed the document and the document detecting unit does not detect the document.

* * * * *